United States Patent [19]

Mastriani

[11] 4,342,433

[45] Aug. 3, 1982

[54] AIR DIFFERENTIAL MANDREL AND METHOD OF DIFFERENTIALLY WINDING AND REWINDING TAPES

[75] Inventor: Elvin A. Mastriani, Roseland, N.J.

[73] Assignee: Arrow Converting Equipment Inc., Fairfield, N.J.

[21] Appl. No.: 236,870

[22] Filed: Feb. 23, 1981

Related U.S. Application Data

[63] Continuation-in-part of Ser. No. 91,504, Nov. 14, 1980, Pat. No. 4,266,737.

[51] Int. Cl.[3] ..... B65H 75/24; B65H 19/04

[52] U.S. Cl. ..... 242/72 B; 242/56.9

[58] Field of Search ..... 242/72 B, 56.9, 72, 242/56.2; 279/2 A

[56] References Cited

U.S. PATENT DOCUMENTS

| | | | |
|---|---|---|---|
| 3,853,280 | 12/1974 | Pennisi | 242/72 B |
| 3,878,999 | 4/1975 | Daves | 242/56.9 |
| 4,209,138 | 6/1980 | Cecchi | 242/56.9 |
| 4,220,291 | 9/1980 | Papa | 242/72 B |
| 4,266,737 | 5/1981 | Mastriani | 242/72 B |

*Primary Examiner*—Edward J. McCarthy
*Attorney, Agent, or Firm*—Harry Sommers

[57] ABSTRACT

An air-controlled differential rewind mandrel for simultaneously winding multiples of web material (slit strips) mounted onto cores in rewind machines having two or more rewind mandrels, means for providing constant torque to each rewind roll formed by the individual slit strips, core engaging shoes formed in arcuate segments positioned around the mandrel, the segments being formed with elongated arcuate outer surfaces having extended purchase contact with the tape winding cores for a substantial part, such as 180 degrees, per rotation of the mandrel, with the inner surfaces of the cores, each shoe being differentially movable relatively to the others as required by tension conditions encountered, and in any desired numerical groupings, and adjustable positional means engageable with the shoes, obviating the necessity for complex adjustment and down time heretofore required to conform to the positions of cores of different widths on the mandrel, and various torque requirements encountered in practise.

16 Claims, 14 Drawing Figures

AIR DIFFERENTIAL MANDREL AND METHOD OF DIFFERENTIALLY WINDING AND REWINDING TAPES

Continuation in part patent application for AIR DIFFERENTIAL MANDREL AND METHOD OF DIFFERENTIALLY WINDING AND REWINDING TAPES, containing additional subject matter; prior application Ser. No. 091,504, was officially allowed Nov. 14, 1980, Group Art Unit 242, now U.S. Pat. No. 4,266,737.

PRIOR ART PRACTICES

A variable factor which affects the simultaneous rewinding of multiple slit strips onto mandrels is the inherent variation in thickness of web material measured in a transverse direction (90° to travel of the web). The condition causes the rewinding roll to vary in diameter proportional to the thickness of the web in each roll. In view of this variation, the rewinding cores (in prior art practice), are allowed to slip on the mandrels in an effort to have each core rotate at the speed required to wind the roll; the cores were assembled alternatively with keyed rings or spacers, a keyway being provided on the mandrel to compel the spacers to rotate at the same revolution as the mandrel. The assemblange of cores and spacers was permitted to move freely in an axial direction. End loading of the mandrels was provided by means of spring or air pressures, to endeavor to vary the rewinding torque and thereby the hardness of the rewinding rolls.

Normally, a winding machine is provided with two spaced rewind mandrels, each mandrel carrying a plurality of alternately-disposed cores and spacer rings. Adjacently-disposed strips of the slit web are directed to different mandrels so that the spacing of the cores on each mandrel is equal to the width of the strips, such spacing being maintained by the core spacers.

The cores on which the slit strips are wound are formed of several layers of heavy paper wound into a rigid tube. The cores are then cut into the desired widths to match the width of the slit strips. It is evident, given the material from which the core is made, that the tolerance of the length of the cut core cannot be held to a precise limit. Consequently, the assemblage of cores and spacers, subject to cumulative dimensions, results in misalignment between cores and slit strips. This condition is called "off-core" which causes defects in the winding of the rolls.

Another inherent disadvantage in prior art practices such as the procedures just described is that the rewinding torque, created by end loading the assemblage of cores and spacers, results in significant variations in the magnitude of torque across the stack. This phenomenon is called "decay" of torque, the end load, affected by the lateral friction of the assemblage of cores and spacers, making it difficult to wind materials such as thin plastic films which require precise torque control.

In order to overcome the problems of varying torque caused by axial loading, several prior art devices have attempted to utilize radial loading by means of fluid pressure or springs. Such devices have proven to be cumbersome and in addition require different mandrels for each slit width pattern, resulting in an excessive investment of equipment.

Another disadvantage of conventional methods is the excessive amount of time required to remove a finished set of rewind rolls from the mandrels, and prepare the mandrel for the next cycle. It was necessary to remove a spacer between adjacent rolls and then reassemble the core and spacer assembly which is time consuming.

APPLICANT'S PRIOR APPLICATION NO. 091,504

The spools 35 in my prior application, Ser. No. 091,504, have line contact with the tape-winding cores 88 (FIGS. 8, 15 of said prior application), in a structure well suited to most purposes. However, in certain cases, as, for example, where there is high loading on the inside of the core, as in the case of winding tapes having substantially greater or other than normal resistance characteristics, the shoes of the present application provide improved and substantially greater and more effective area contact of each shoe with the tape winding core as distinguished from line contact, providing the important advantage of extended surface purchase contact with the core being rewound, and providing further advantages in application and operation, such as obviating scoring or marking or excess wear and reducing the unit pressure on, the inside of the core, while achieving the required torque.

OBJECTS OF THE PRESENT INVENTION

This invention provides a mandrel which differentially rewinds slit strips, applying a radial load to each core rather than axial loading as described in *Prior Art Practices* above; thus interaction between adjacent cores and spacers, such as was caused by axial loading, is eliminated and a degree of preciseness of torque is obtained not possible in prior art, with resultant ability to wind rolls to the proper hardness required.

Where it is desired to mount cores of different widths on a mandrel, resulting in varying lengths of core groups, the invention of the present application provides further adjustment means obviating the necessity (as in prior art devices) of down time for that purpose. Novel spring and slot holding means adjust to the desired position.

Another advantage of this invention is that the cores are located in the exact location required by means of interchangeable "tooling" consisting of shoes which are mounted on rods. The upper surface of the shoe is reduced for a width equal to the width of the core, thereby forming a registration position into which the core locates. The shoes are provided with transverse apertures larger than the diameter of the rods on which they are assembled, allowing the shoes to "float" on the rod. The reduced outside diameters of the central portions of each shoe assures the positive location of each new core as it is slipped onto the mandrel for the next rewinding cycle.

The rewind mandrels are generally provided with four rows of shoe assemblies, equally spaced about the periphery of the mandrel in grooves or keyways. Inflatable tubes are located under each shoe-rod assembly; by varying the fluid pressure in the rubber tubes, the amount of torque transmitted to each core by the shoe will correspondingly vary.

To unload the finished rolls off the mandrel, it is necessary only to deflate the rubber tubes; the finished rolls are quite easily slipped off.

A further advantage of this invention is that the shoe-rod assemblies provided for each slit width pattern, may be easily and quickly changed for other slit width patterns; this, in addition, greatly reduces the required investment, as opposed to other methods (such as in radial loading) which require a completely different set of mandrels for each slit width and substantial "down time" as described above.

A further advantage of this invention is that, by utilizing a rotary coupling on the slitter rewinder to inject fluid continuously, it is possible to vary the fluid pressure during the rewinding cycle to vary the rewinding torque as required by the material being processed.

In the drawings, wherein similar reference characters indicate like parts:

FIG. 1 is a schematic, partly broken, perspective view of a core engaging shoe member embodying the invention, shown movably mounted on an elongated alignment rod member freely passing through an aperture therein, the tape-winding core engaged by said shoe being shown fragmentarily and in dotted lines, FIG. 2 is a vertical, sectional, elevational view of a mandrel casing embodying the invention, FIG. 3 is a similar view, showing pressure medium means and shoes mounted in outwardly opening recesses formed in the mandrel, FIG. 4 is a vertical, sectional view taken at line 4—4 of FIG. 8, FIG. 5 is a schematic, vertical elevational, partly sectional, view taken at line 5—5 of FIG. 7, showing the spring 71 positioned in the slot 74 and overlying the shoe engaging member, FIG. 6 is a view, similar to FIG. 4, but of another embodiment of the invention wherein the mandrel is formed with four axial recesses for pressure medium members and core engaging shoe members, FIG. 7 is a perspective top plan view of a mandrel and associated parts embodying the invention, FIG. 8 is a fragmentary, perspective view of a mandrel and associated core engaging shoe members and cores thereon pursuant to the invention, FIG. 9 is a partly broken, sectional view of a flexible pressure medium tube means which may be used in carrying out the invention, FIG. 10 is a fragmentary, plan view, of an alignment rod which may be passed through the core engaging shoes, FIG. 11 is a partly sectional, elevational view of a form of one end of the mandrel and journal to be engaged and disengaged therewith, which may be used in carrying out the invention, FIG. 12 is a fragmentary, sectional view of a form of the other (air intake) and of the mandrel, which may be used in carrying out the invention, FIG. 13 is a vertical, sectional view of an air intake journal which may engage and disengage a (FIG. 12) air intake end of the mandrel in carrying out the invention, and FIG. 14 is a schematic view of a typical tape slitting apparatus which may be used in connection with the invention.

DESCRIPTION OF PREFERRED EMBODIMENTS

Figure 14:
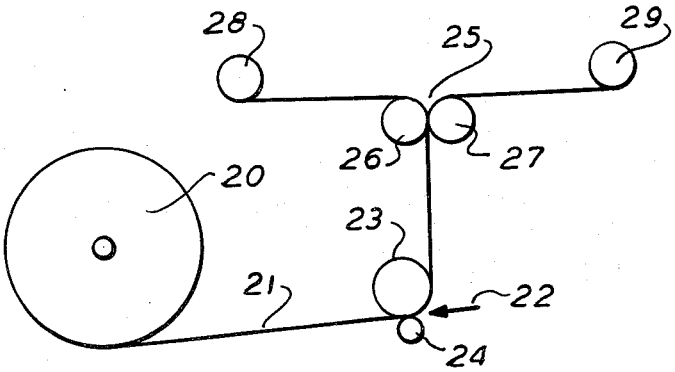

The air differential mandrel of this invention rewinds tapes from a web source of plastics, paper, textiles, foils, and other materials suitable for rewinding onto shoes on a mandrel. A typical example of application of the invention, and without limitation thereto, FIG. 14 schematically shows web 21 fed from a source roll, such as 20, through a slitting station 22, having an idler or backup roll 24 and knives or slitters 23 slitting the web 21 into parrell tapes, which are moved as at 25 over idler rolls 26, 27 and then to tape rewinding mandrels 28, 29. Each mandrel, such as schematically indicated at 28, 29 in FIG. 14 and 32 in FIGS. 2–7 of the present application, without limitation thereto, rewinds alternate tapes cut from web 21. The invention is adapted for use in any other procedure or operation in which tapes are slit and fed onto one or more mandrels.

Figure 6:
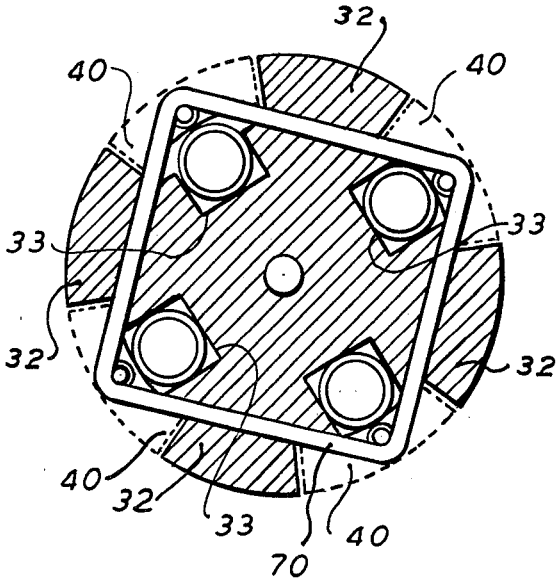
Figure 7:
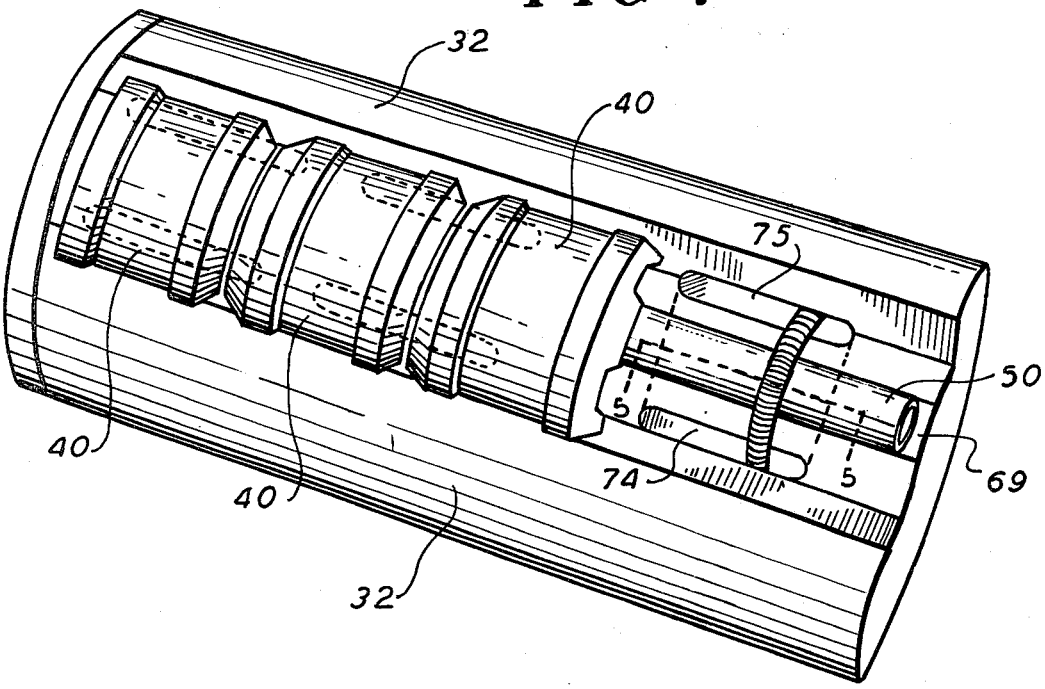

The mandrel embodying a preferred embodiment of the invention comprises (FIGS. 2–7) an elongated mandrel body 32, preferably of circular or other cross-sectional form, and having formed therein a plurality of preferably equidistantly spaced outwardly radially directed and opening slotted portions 33, formed thereon of the number desired, exemplarily shown in FIG. 6 of the drawings as spaced apart 90° (but which may be (FIGS. 3, 4) spaced apart in any other desired spatial arrangement desired; for example and without limitation thereto, they may be spaced apart a smaller or greater number of degrees. Flexible expandible pressure medium means 50 are disposed in the mandrel slotted portions 33 to have contact with the core engaging shoes 40 (FIGS. 1, 3 7) disposed in rows (FIG. 7) aligned relative to the flexible pressure means tubes 50, along the longitudinal axis of the mandrel.

Figure 8:
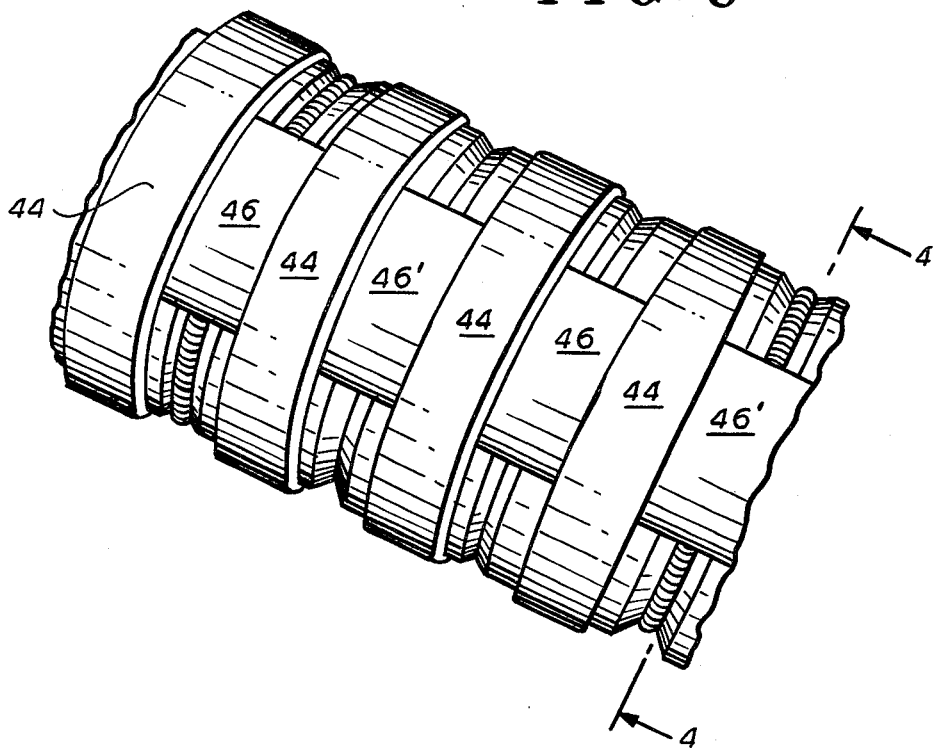

In my prior application, Ser. No. 091,504, allowed Nov. 14, 1980, Group Art Unit 242, the tape winding spools or sleeves 35 had (FIG. 15 of said application) line contact with the tape winding cores (88 in said FIG. 15). It will be noted from FIG. 8 of said prior application, that where the mandrel was provided with four (90 degrees apart) sleeve receiving recesses 33, four line contacts were made by the sleeves with the core (88). That arrangement is effective and efficient for most applications. However, under some special conditions, as where the cores are made of exceptionally heavy material or have exceptionally severe and differing caliper variations, or where, for any other reason, unusually severe variations in torque are encountered from tape to tape or from core to core, or, due to other conditions, high line loading of the inside of the core ensues.

The invention of the present application recognizes and is addressed to this problem and solves it by novel means including forming the core engaging shoe 40 of special and novel features as described and claimed herein:

The improved core-engaging shoe 40 is preferably made of a rubber or rubber-like material molded or otherwise formed with a segmented arcuate upper surface elongated and axially extended as at 41 (FIG. 1) for engagement with the undersurface 45 of the core 44. The core engaging shoe 40 is further defined by spaced, parallel elevated upper marginal edge portions 46, 46' for registry of the upper surface 41 of the shoe with the underside of the core (FIG. 1).

Figure 1:
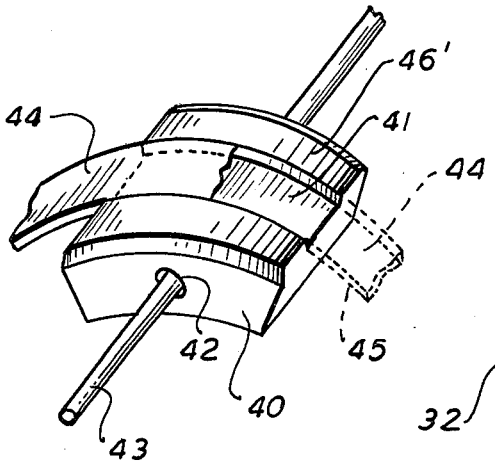
Figure 2:
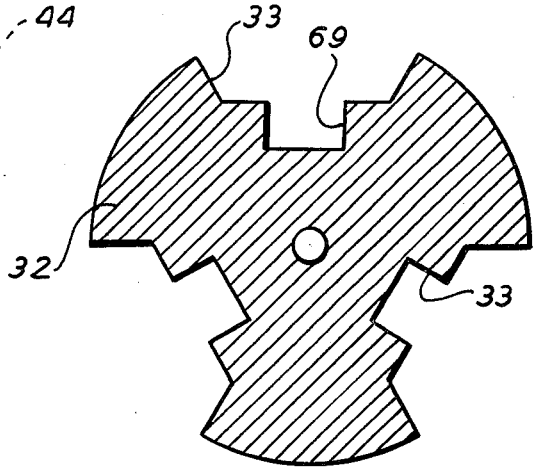
Figure 3:
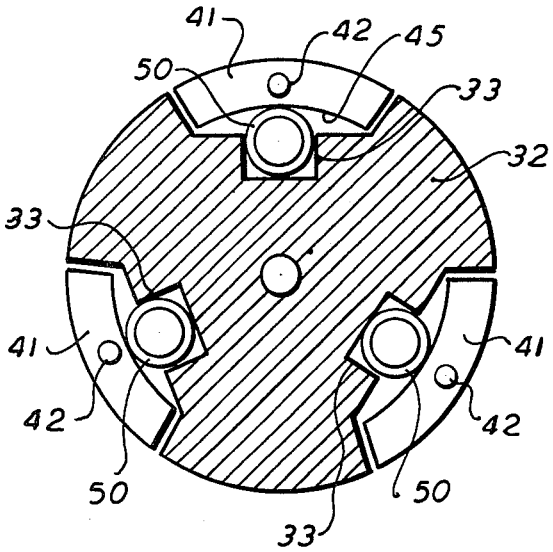
Figure 10:
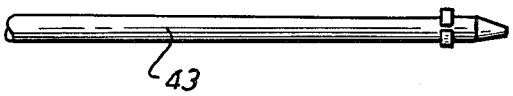

Alignment rod 43 (FIGS. 1, 10, 4) passes freely through apertures 42 formed transversely through the shoes 40, said apertures being larger than the transverse cross-section of the rod 43 (FIG. 1). The alignment rod thus aligns one or more shoes 40 (FIGS. 7, 8) in the recesses 33 (FIGS. 2–4) of the mandrel 32 in alignment with the longitudinal axis of the mandrel (FIG. 7) and in rows in the recesses 33 of the mandrel parallel to said longitudinal axis and in contact with the pressure medium tubes 50 therein.

A plurality of core engaging shoes 40 may thus be positioned in alignment on a rod 43, with each shoe vertically movable on the rod 43 independently of the position of the adjacent or other spools of the row, whereby the tapes wind onto each spool under uniform tension, notwithstanding variations in dimensions or characteristics of windings of other tapes due to humidity and other manufacturing differences in the individual tape strips and variations in caliper of the tapes and cores, due to any reason.

Figure 9:
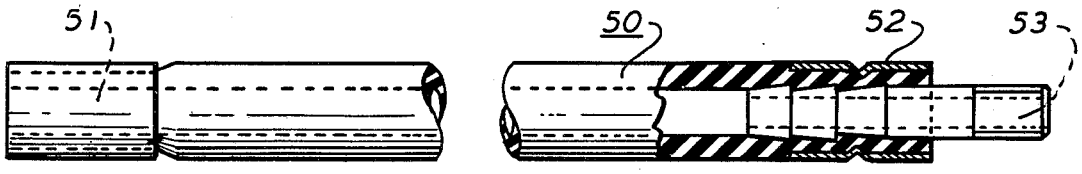
Figure 13:
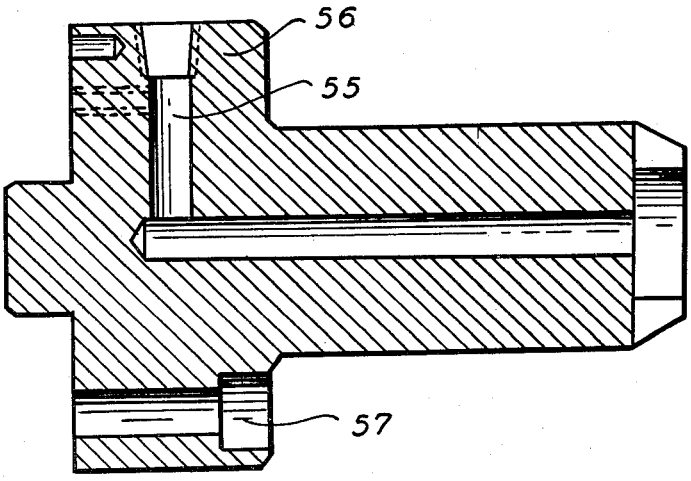

The pressure medium means 50 (FIGS. 9, 3–7) comprise elongated inflatible flexible, expansible tubes 50 disposed at the inner ends (FIGS. 2, 3) of slots 33 formed radially longitudinally in the mandrel and made of any suitable material, such as rubber, the core engaging shoes 40 being, as above noted, positioned on said pressure medium means 50 and urged thereby radially outwardly for engagement with the cores 44. The tubes 50 are preferably formed to inflate to circular form (FIGS. 3–6) and are (FIG. 9) preferably closed at one end by suitable means such as closure plugs 51; the other (air intake) ends of the inflatable flexible tubes 50 may be reinforced as by external metallic or other sleeves or ferrules 52 and provided with an internal tubular connector or stud 53 registrably connectable with an air passageway 55 (FIG. 13) of air intake journal 56 bolted or otherwise secured to the air intake end (FIG. 13) of the mandrel, by suitable means, such as by bolts positioned in registration openings 57 of the air intake journal 56 and threaded into internally threaded recesses 58 of the air intake end of the mandrel body 32 and through mandrel passageways such as 36 (FIG. 2 of Application Ser. No. 091,504) to the pressure medium tubes.

Figure 4:
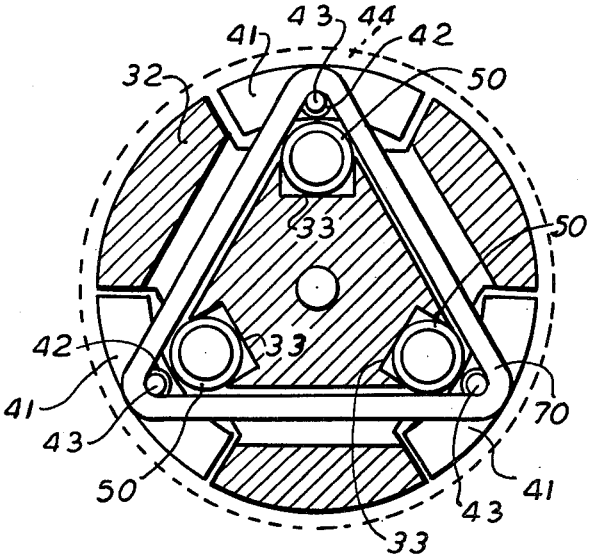
Figure 5:
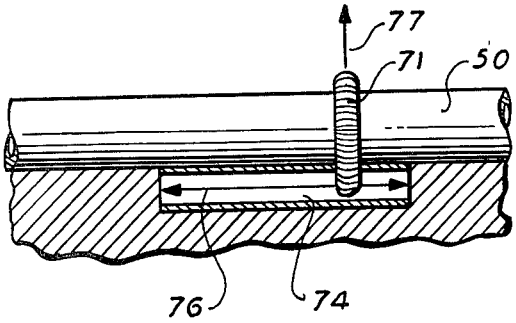
Figure 11:
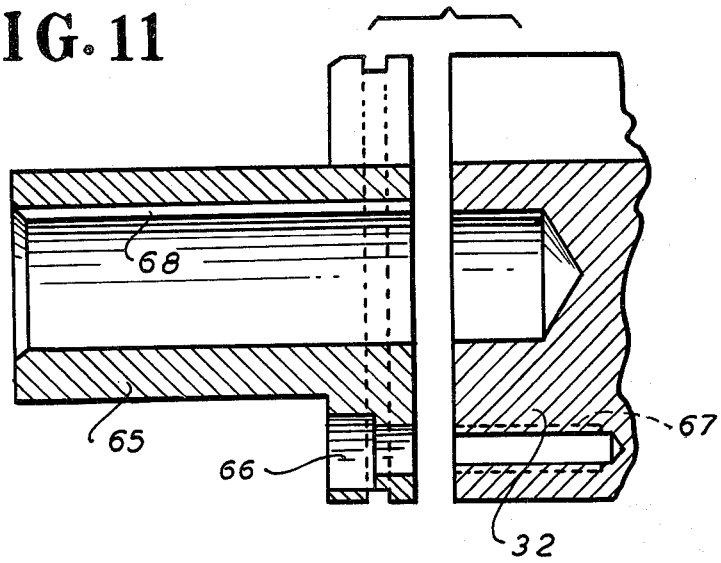
Figure 12:
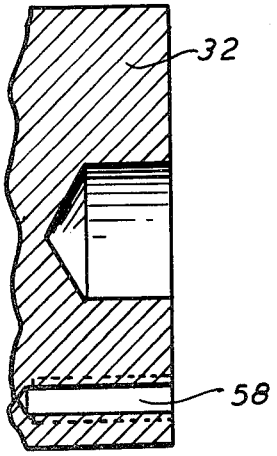

Mandrel 32 may be installed in a winding machine and rotated by any suitable means; for example (FIG. 11), journal 65 may be secured to one end of the mandrel (as in FIGS. 4 and 1 of my prior application, Ser. No. 091,504) by (FIG. 11 of the present application) bolt or other means positioned in bolt receiving socket 66 in the journal 65 and threaded into the threaded aperture 67 in the mandrel 32. The journal 65 may include a hub having a longitudinal keyway to receive a splining member; a key carred by journal 65 may guide the spline in aligned longitudinal movement relative to the keyway; a screw may lock a spline in the keyway 68 at the desired position.

An air injector unit of any form well known in this art, may be engageable with means such as the air intake journal 56 (FIG. 13) movably positioned for actuation by suitable means such as by compressed air; means such as a rod plunger when actuated may move air intake journal 56 into operative registration with the air intake passageways in the mandrel connected with pressure medium tubes 50. A suitable compressed air supply source and valve means may be connected to the air intake journal 56 and connected to a compressor source through a control valve, to valve compressed air to intake journal 56 and thence to the flexible air pressure tubes 50 (FIGS. 4–7, 9). Any other suitable means for supplying air to the mandrel air tubes 50 may be used within the purview of this invention, such as the means exemplarily described in my prior application, Ser. No. 019,504 or other means known in the art and for assembly of the mandrel. By such means the mandrel may be readily used to retrofit machines of various types, originally intended for use with other rewinding mandrels and equipment, as well as to be positioned in new machines.

The shoes 40, made of rubber or other suitable material, are held in axial line rows by "0" springs 70 (FIGS. 4, 6 8) which may be partially positioned in circumferential recesses in the mandrel and in the core engaging shoes 40. The tubes, when inflated, expand and press against the shoes 40 on which the tape loading cores 44 are positioned (FIG. 1), automatically tensioning the cores mounted on the shoes proportional to the resistance of the cores against rotation in the rewinding operation, pursuant to the invention.

FURTHER FEATURES AND ADVANTAGES OF THE PRESENT INVENTION

The invention is further especially useful in rewinding tapes having gauges that are substantially off caliper, in manufacture and storage and use, for example, where ripples, caused in sections of a mill roll, are present in the tapes or where there are visible bumps in the mill roll so that sections thereof (thus tape portions slit therefrom) are slightly thicker. In slitting and rewinding such rolls, thicker sections of the web material, when slit to tape form, and rewound, would cause the cores whereon they are rewound to slip more than those whereon adjacent, uniform, portions of the source web (and thus of tapes slit therefrom) are rewound. Caliper variations also often occur in cases of laminated material or any other material that has been coated - for example, adhesive-coated film, or paper laminated to another product such as printing film; in laminated mill rolls, where there is printing along the surface, the web source would be thicker in the areas laminated; where printing ink has been supplied the same conditions occurs. The mandrel of the present invention automatically differentially rewinds tapes with relation to the specific torque requirements of each tape as encountered in the rewinding procedure.

The invention assures that the torque transmitting tension, being a function of the inside of the core, the outside of the mandrel and the amount of pressure for each core, will automatically be the amount required by it. Hence, pursuant to the procedures of the present invention, though there may be substantial material variations encountered, the torque on all cores will be the same.

The shoes 40 on the various cores along the mandrel are not attached to the mandrel; they thus each move independently of the others due to their "free floating" mounting on the rods 43 and their contact with the flexible pressure means 50—important features of the invention.

It is often desirable to slit tapes of different widths on the same mandrel. Conventional mandrel systems did not achieve this objective while satisfying the tension requirements of each strip; the present invention achieves this readily and efficiently by enabling an infinite number of different slit tape widths to be rewound in the rows of cores of different characteristics and lengths on the same mandrel, rows with each different core receiving the torque appropriate to it.

"0" spring means 70 are shown in FIGS. 1–4 and 8 for holding rows of shoes 40 on the mandrel. Further holding means (FIGS. 5 and 7) may be provided, pursuant to this invention, adjustable to conform to random positions of groups or rows of shoes, by forming an elongated slot 74 in the mandrel below and adjacent the inner ends 69 of slotted portions 33 of the mandrel. A spring such as "0" spring 71, may be positioned through an end of slot 74 and out of the second end 75 thereof and may be moved axially within the length 76 of the slot to the precise location desired, for example, for engagement of the spring with an end shoe or with the rod passing therethrough or with rows of shoes.

Preferred embodiments of the invention have been set forth above. It is to be understood, however, that variations may be made in such preferred embodiments, within the scope and spirit of the invention. The invention is therefore to be broadly construed within the scope and spirit of the claims herein.

I claim:

1. Tape winding, core engaging means for winding tapes differentially from a source onto a tape winding core, on rotation of an elongated mandrel body member having flexible pressure means disposed therein; said tape winding, core engaging, means comprising:

(a) a core engaging shoe member disposed on the mandrel in registration with the pressure means therein and thereby urged outwardly thereon, (b) an elongated rod member passing through said core engaging shoe member and aligning the same on the mandrel flexible pressure means, (c) said core engaging shoe member being formed with an extended arcuate outer surface in a plane at right angles to the longitudinal axis of the mandrel when so disposed thereon and extending outwardly for contact with said tape winding core member, (d) whereby tape may be wound onto said core under constant tension on rotation of the mandrel, notwithstanding caliper variations in the tape.

2. In tape winding, core engaging means for winding tapes differentially from a source onto a tape winding core, on rotation of an elongated mandrel body member, as set forth in claim 1, said core engaging shoe member, on engagement with said pressure means, being so urged outwardly of the mandrel and into engagement of the said extended arcuate outer surface of the shoe member with the underside of the core under pressure.

3. In tape winding, core engaging means for winding tapes differentially from a source onto a tape winding core, on rotation of an elongated mandrel body member, as set forth in claim 1, said core engaging means comprising a shoe member of axially extended form, with an extended arcuate undersurface for engagement with said pressure means, said alignment rod member being so disposed through said core engaging member at right angles to the longitudinal axis thereof.

4. In tape winding, core engaging means for winding tapes differentially from a source onto a tape winding core, on rotation of an elongated mandrel body member, as set forth in claim 1, said core engaging means comprising a shoe member having an extended outer surface arcuately complementary to the tape winding core member, for frictional purchase contact engagement therewith on engagement of the pressure means with said core engaging shoe member.

5. In tape winding, core engaging means for winding tapes differentially from a source onto a tape winding core, on rotation of an elongated mandrel body member, as set forth in claim 1, guide means on said core engaging shoe member for registration of the core therewith.

6. In tape winding, core engaging means for winding tapes differentially from a source onto a tape winding core, on rotation of an elongated mandrel body member, as set forth in claim 1, said core engaging shoe member having an extended outer surface, and registration guides on said outer surface for registration of the core with said shoe member.

7. In tape winding, core engaging means for winding tapes differentially from a source onto a tape winding core, on rotation of an elongated mandrel body member, as set forth in claim 1, said core engaging shoe member being formed with an arcuately disposed elongated lower surface for engagement with said pressure means.

8. In tape winding, core engaging means for winding tapes differentially from a source onto a tape winding core, on rotation of an elongated mandrel body member, as set forth in claim 1, said core engaging shoe member being formed with arcuate guide means for registration of the core member therewith, and said core engaging shoe member being further formed with a lower surface parallel to and spaced from the outer surface thereof, for engagement with said pressure means.

9. In tape winding, core engaging means for winding tapes differentially from a source onto a tape winding core, on rotation of an elongated mandrel body member, as set forth in claim 1, said mandrel being formed with a radially inwardly extending recessed portion parallel to the longitudinal axis thereof, said core engaging member being disposed in said recessed portion of the mandrel.

10. In tape winding, core engaging means for winding tapes differentially from a source onto a tape winding core, on rotation of an elongated mandrel body member, as set forth in claim 1, said mandrel being formed with radially spaced, inwardly extending recessed portions extending axially therealong and opening at the circumferential edge of the mandrel, for reception of the core engaging shoe members in spaced circumferential relation, whereby the mandrel, intermediate the so radially spaced, inwardly extending recessed portions, defines spacing portions therefor.

11. In tape winding, core engaging means for winding tapes differentially from a source onto a tape winding core, on rotation of an elongated mandrel body member, as set forth in claim 1, said mandrel being formed with radially spaced, inwardly extending recessed portions extending axially therealong and opening at the circumferential edge of the mandrel, for reception of the core engaging shoe members in spaced circumferential relation, the mandrel, intermediate the so radially spaced, inwardly extending recessed portions, defining spacing portions therefor, said inwardly extending recessed portions extending along the circumference of the mandrel for about one-half said circumference.

12. In tape winding, core engaging means for winding tapes differentially from a source onto a tape winding core, on rotation of an elongated mandrel body member, as set forth in claim 1, said mandrel being formed with radially spaced, inwardly extending recessed portions extending axially therealong and opening at the circumferential edge of the mandrel, for reception of the core engaging shoe members in said spaced circumferential relation, the mandrel, intermediate the so radially spaced, inwardly extending recessed portions, defines spacing portions therefor, said core engaging shoe members in said recessed portions intermediate the spacing portions being preferably disposed along the circumference of the mandrel for about one half said circumference.

13. In tape winding, core engaging means for winding tapes differentially from a source onto a tape winding core, on rotation of an elongated mandrel body member, as set forth in claim 1, said mandrel being formed with radially spaced, inwardly extending recessed portions extending axially therealong and opening at the circumferential edge of the mandrel, for reception of the core engaging shoe members in said spaced circumferential relation, and whereby the mandrel, intermediate the so radially spaced, inwardly extending recessed portions, defines spacing portions therefor, said core engaging shoe members in said recessed portions and intermediate the spacing portions being preferably disposed along the circumference of the mandrel for about 180 degrees.

14. In tape winding, core engaging means for winding tapes differentially from a source onto a tape winding core, on rotation of an elongated mandrel body member, as set forth in claim 1, said mandrel being formed with a radially inwardly extending recessed portion parallel to the longitudinal axis thereof, said core engaging member and said pressure means being disposed in said recessed portion of the mandrel, elongated slot means provided in the mandrel adjacent the recessed portion therein for reception of said pressure means, and spring means in said slot means and extensible therefrom at desired positions along said slot means, for engagement with the core-engaging shoe member, to hold the latter in desired selected position on the mandrel.

15. A method of differentially winding tape from a source onto a core on a mandrel on rotation of the mandrel, said mandrel being provided with an axially slotted portion opening circumferentially thereof and with a core engaging shoe movable in said slotted portion, said method comprising:

positioning expansible pressure means in said slotted portion of the mandrel, positioning alignment means in said slotted portion in engagement with said core engaging shoe member, enabling vertical movement of said shoe member responsive to said expansible pressure means applied thereto, providing said core engaging shoe member with an extended arcuate outer surface complementary to the core member, for frictional engagement therewith on application of pressure thereto, and expanding said expansible pressure means, against the core engaging shoe member, pressing the latter against said tape winding core, applying torque to the core and tape wound thereon on so rotating the mandrel.

16. A method of differentially winding tapes onto tape winding core members on rotation of a mandrel provided with an axially slotted portion opening circumferentially thereof and with expansible pressure means in said slotted portion, said method comprising the steps of:

positioning a plurality of core engaging shoe members on said expansible pressure means, positioning an alignment rod through said core engaging shoe members, said core engaging shoe members thereby being independently movable on said rod, said core engaging shoe members having arcuate upper surfaces complementary to said core winding members, and expanding said pressure means in said mandrel, said core engaging shoe members so moving independently on said rod, and against said tape winding core members, thereby so applying differential torque to the cores and tapes so wound thereon on rotation of the mandrel.

* * * * *